United States Patent [19]

Fletcher et al.

[11] 4,327,652

[45] May 4, 1982

[54] BUTTON CLAMP ASSEMBLY

[75] Inventors: Roy W. Fletcher, Riverdale; Anthony D. Forte, Chicago, both of Ill.

[73] Assignee: Union Special Corporation, Chicago, Ill.

[21] Appl. No.: 273,528

[22] Filed: Jun. 15, 1981

[51] Int. Cl.[3] ..... D05B 3/14; D05B 97/00

[52] U.S. Cl. ..... 112/110; 112/265.1; 112/113

[58] Field of Search ..... 112/110, 112, 104, 113, 112/265.1, 262.1; 221/173, 133, 156, 186, 267, 123

[56] References Cited

U.S. PATENT DOCUMENTS

| | | | |
|---|---|---|---|
| 194,005 | 8/1877 | Sherwood | 112/104 |
| 685,815 | 11/1901 | Chilten | 112/110 |
| 2,945,575 | 7/1960 | Halbreich | 112/104 X |
| 3,123,251 | 3/1964 | Schneider, Jr. | 221/156 |
| 3,565,285 | 2/1971 | Asnes | 221/267 |
| 3,807,328 | 4/1974 | Lombardo | 112/265.1 X |
| 3,837,530 | 9/1974 | Snyder | 112/113 X |
| 3,960,094 | 6/1976 | Hsiao | 112/110 |
| 4,050,392 | 9/1977 | Taddicken | 112/113 |
| 4,069,777 | 1/1978 | Ishikawa | 112/113 |

*Primary Examiner*—H. Hampton Hunter

*Attorney, Agent, or Firm*—John W. Harbst; John A. Schaerli

[57] ABSTRACT

A button clamp assembly having an unalterable pivot and provided with interchangeable turret assemblies which cooperate with other universal assemblies in controlling the planar displacement of the articles being delivered to the machine's sewing station. The interchangeable assemblies are mounted in a manner permitting a consistent clamping relationship to be maintained between the turret assembly and the machine's work support regardless of the article's thickness or ligne/-diameter.

10 Claims, 6 Drawing Figures

58
70
80
78
62
74
76
72
70
74
60
72
10
12
14
16
18
20
22
24

BUTTON CLAMP ASSEMBLY

FIELD OF THE INVENTION

The present invention is concerned with sewing machines and, more particularly, with a sewing machine adapted to advance plate-like articles to the sewing instrumentalities of the machine.

BACKGROUND OF THE INVENTION

The present invention is an improvement of the apparatus shown in U.S. Pat. No. 3,960,094 granted June 1, 1976 to J. C. Hsiao.

The mechanism shown in the above-identified patent includes a button positioning apparatus mounted on a pivotal clamp. The button positioning apparatus includes a conveyor or turret means rotatably secured to the clamp by a bolt. The conveyor is adapted to receive and automatically index a plurality of buttons or other plate-like articles through a series of steps. In its path to the sewing station, each button is properly aligned by a mechanical orientating mechanism that works in consort with the indexing drive. In operation, the clamp is lowered and the button conveyor means is urged into contact with the workpiece being sewn. Upon completion of the button sewing cycle, the clamp is raised, the sewn button extracted and another orientated button is automatically indexed into the sewing position. Thereafter, the clamp is again lowered and the next button sewing cycle commences.

When the clamp is lowered, a proper relationship between the button conveyor and the machine's work support must be maintained. This relationship is especially apparent in the immediate sewing area. If the button conveyor in not properly maintained with respect to the work support surface, inadequate clamping of the workpiece may result whereby effecting workpiece movement. If the workpiece does not move in consort with the button movement an improper stitch formation can result. Thus, maintenance of a proper clamping relationship between the button conveyor and workpiece support is important.

The relationship between the button turret and work support is easily accomplished when predetermined button thicknesses are being consistently sewn. At the present state of art, however, it is customary to sew one size, shape and design of button one day and a different design, size and shape the next day. This introduction of new or different button sizes presents certain problems. For example, significant or radical changes in button sizes demand various sized button turrets. Understandably, one size button turret cannot functionally accommodate all button sizes. Therefore, various sized button turrets dimensioned as a function of button diameter and thickness are provided. It is easily perceived, however, that the button turret for handling the smallest, thinnest button will be sized differently from that equipped to handle the largest, thickest button. To change button turrets on the apparatus shown in the Hsiao patent affects other machine elements. Without the instant invention, a radical dimensional change in button thickness would require not only a change in button turrets but also a different, correspondingly sized, bolt for securing the turret to the clamp; possibly a new clamp whereby assuring the proper clamping relationship between the turret means and the work support; and a new orientating mechanism with appropriately sized orientating pins. The inventory costs for such a multitude of parts to fit a complete range of button sizes would, of course, be prohibitive. Thus, a compromise in the design of parts, so as to enable operation of the machine on the various button sizes, would appear to be the only feasible alternative to solving the problem.

Significant changes in button thicknesses have other affects as well. A compromise in parts to fit a wide range of button thickness affects the amount of control maintained over the button's planar orientation. Unless the planar orientation of the button is controlled, the buttons could "ride up" on each other whereby causing starvation of the gravity fed buttons to the turret or a jam in the turret, resulting in a machine malfunction. Accordingly, changes in button thicknesses required various dimensioned mechanisms to satisfactorily accommodate various sized buttons.

The mechanisms shown in U.S. Pat. No. 4,069,777 granted on Jan. 24, 1978 to Y. Ishikawa advanced the method of presenting articles to the button turret, but the demand for control of button thicknesses by a modular mechanism remained unanswered. Thus, the heretofore known methods of presenting and indexing a button to a securing station, have serious drawbacks which have heretofore remained unsolved.

SUMMARY OF THE INVENTION

In view of the above, and in accordance with the present invention, there is provided a modular clamp assembly having interchangeable button turret assemblies. The present invention serves the ultimate purpose of receiving and transporting a range of diameters of buttons from a loading station to the machine's sewing station. Moreover, the present invention maintains control of the button's planar displacement regardless of button thickness without a corresponding change in multitude of parts.

The problem of overcoming the heretofore mentioned drawbacks essentially is solved in two steps. First, an optimum clamping relationship is established between the button turret assembly and the machine's work support regardless of button thickness. That is, the turret assembly for the largest diameter thickest button has the same relationship with the work support as has the turret assembly capable of handling the smallest diameter and thinnest button. Thus, maximum clamping is accomplished regardless of button size. Second, a series of modular or universal components are used to their fullest potential to reduce inventory whereby allowing a full range of button sizes to be sewn without compromising on control of the button's planar orientation. The present invention contends with meeting the optimum clamping relationship between the clamp and work support by adjustably mounting each turret or button receiving subassembly to the clamp whereby assuring a constant setting between the clamp and the button turret. Having once established a constant disposition for the turret assembly, a number of other advantages flowed therefrom. In comparison with the heretofore known mechanisms, when a series of various length securing means were required for fastening the turret to the clamp, the present invention employs a single or universal button turret fastener. Also, the constant relationship between the clamp and the button turret allows the introduction of a modular orientating mechanism which is adaptive to various thicknesses of buttons. Furthermore, a universal clamp assembly having an unalterable pivot point is employed in mounting the turret assembly on the machine.

To control the button's planar positioning, the present invention includes a modular loading station assembly. The loading station assembly includes an adjustable guide track assembly disposed intermediate the turret assembly and the button supply. The button guide assembly is arranged on the button clamp in a manner whereby the button is presented to the button turret with a minimum amount of interference. Also, the button guide is universally adjustable. That is, the guide assembly can be adjusted to compensate for a button diameter as well as button thickness. With the design and arrangement of the type herein described, it is possible to convey any thickness of button to the sewing station of the machine automatically while controlling the button's planar displacement to minimize the chance of machine malfunction.

In summary, the present invention presents a modular clamp assembly means having interchangeable components which provide a constant workpiece clamping effect regardless of button thickness or diameter. It is the primary object of this invention to provide a modular button indexing assembly having interchangeable parts which permit the button conveyor means and the clamp to maintain a constant relationship regardless of button size.

A further object of the present invention is to provide a modular clamp structure having various sized interchangeable components, the combination of which affect proper alignment and present plate-like articles to the sewing area of the machine in such a way that a consistent clamping position is properly maintained regardless of the size of the interchangeable parts employed.

It is another object of this invention to provide a button sewing machine which includes a series of universal parts adapted for use with interchangeable components for controlling the planar displacement of the button from the supply source to the sewing station of the machine.

BRIEF DESCRIPTION OF THE DRAWINGS

These and further objects and features of the machine will become more clearly apparent during the course of the following disclosure and drawings in which.

DETAILED DESCRIPTION OF THE DRAWINGS

Figures 1, 5:
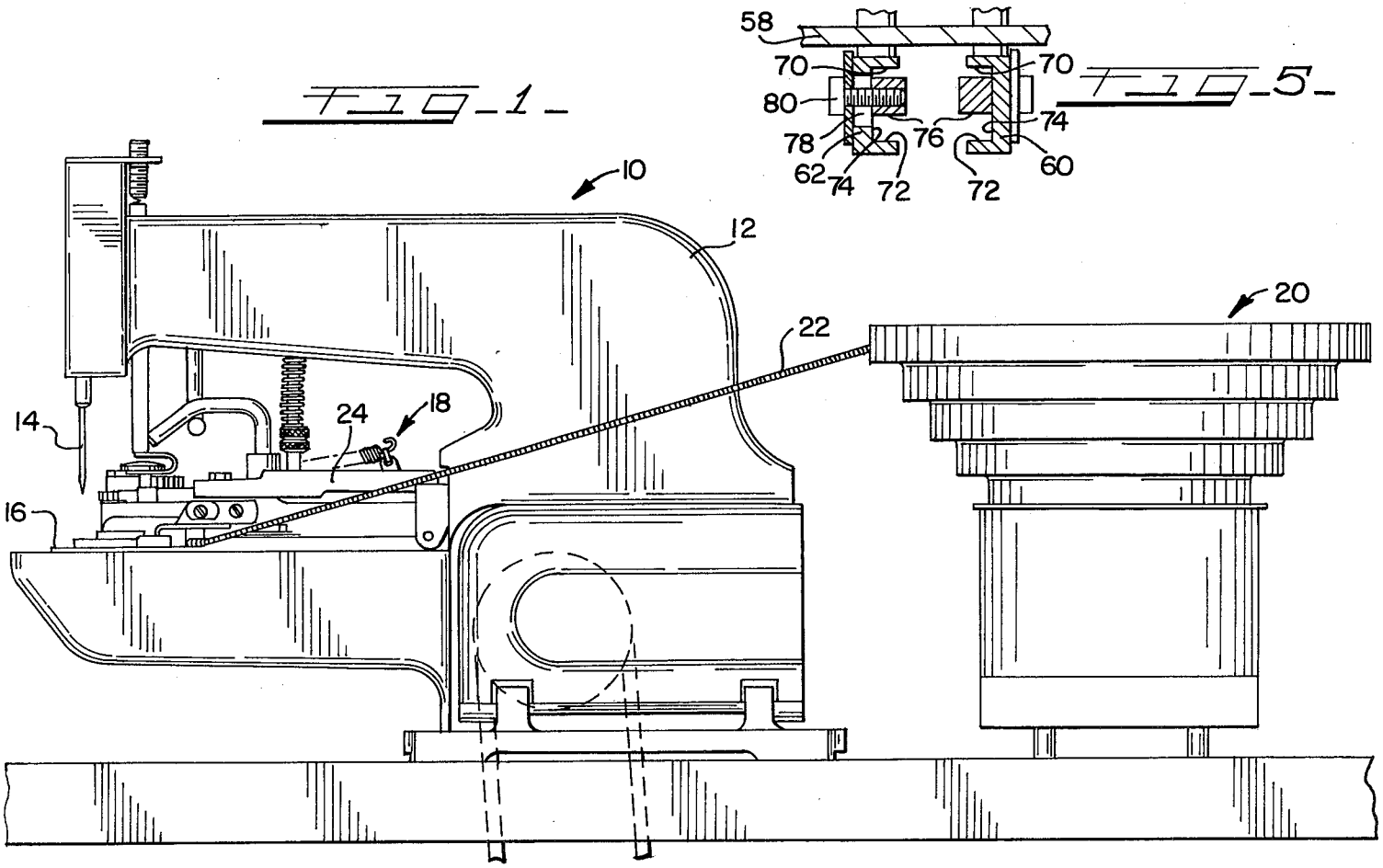
FIG. 1 is a view showing the invention hereunder consideration secured to a button sewing machine with an attendant button feeder.
FIG. 5 is a partial sectional view taken along Line 5—5 of FIG. 3.
Figure 2:
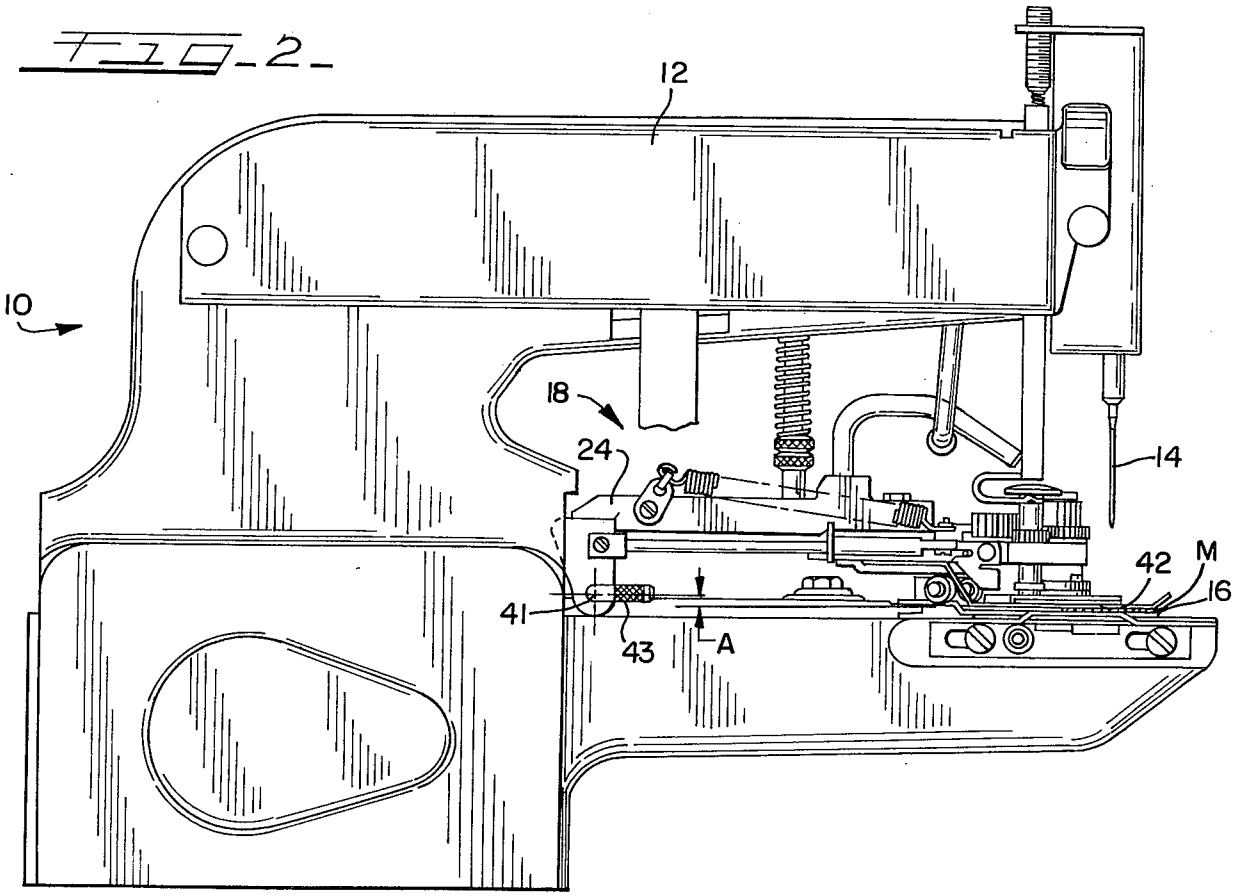
FIG. 2 is a side view of a button sewing machine partially broken away showing the invention hereunder consideration in a workpiece engaging position.
Figure 6:
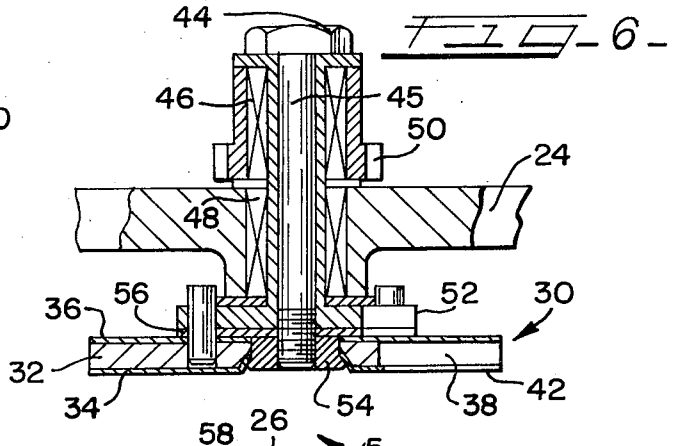
FIG. 6 is a partial sectional view taken along Line 6—6 of FIG. 3.

Referring now to the drawings, wherein like reference numerals indicate like parts throughout the several views, there is shown a sewing machine 10 which embodies the principles of the present invention. The machine illustrated is of the general type disclosed in U.S. Pat. No. 3,960,094 granted June 1, 1976 to J. Hsiao and incorporated herein by reference. Suffice it to say, the machine includes a frame 12, sewing instrumentalities including reciprocatory needle means 14 defining a sewing station, a work support means 16, and a modular clamp assembly 18. Associated with the sewing machine, and more particularly, with the clamp assembly 18, it is a button hopper or supply drum 20. The hopper or supply drum may be mounted adjacent the machine and may be of a known vibratory type. The hopper is adapted to retain a supply of buttons or plate like articles and to feed same, in succession and by gravity, from the drum to the button clamp assembly through a connecting resilient chute 22.

The clamp assembly 18 of the present invention incorporates the concepts of modularity and interchangeability to meet the objectives mentioned above. That is, with the present invention, one assembly may be transferred to any of a plurality of machines as a complete unit and with interchangeable subassemblies can easily adapt to a wide variety of buttons regardless of button diameter or thickness. The clamp assembly includes a universal bracket or lever means 24, a universal loading mechanism 26, a universal indexing mechanism 28, and interchangeable button turret means 30. Each interchangeable subassembly includes button holder means 32, a button retaining element means 34 and a cover plate 36. The button turret assembly 30 is provided with a series of button receiving apertures 38 that are equally spaced about the periphery thereof. Each button receiving aperture in the button holder is provided with a spring assembly 40 which provides a resilient force for holding a button whereby various diameter buttons may be sewn with a single button holder. The button holder assembly is also dimensioned as a function of button thickness. Thus, the planar orientation of the button is controlled throughout its delivery to the sewing station. That is, the planar orientation of the button is controlled from the point where it is presented to the turret until it is sewn to the workpiece.

As mentioned above, without the present invention radical variances in button thicknesses would result in a multitude of various parts for controlling the button displacement. The differences in parts, however, creates different clamping relationships between the button indexing assembly and the work support of the machine and, thus, affects the clamping relationship of the workpiece. Proper and consistent clamping of the workpiece against the work support is demanded to assure movement of the clamp and workpiece, in consort, during the stitch forming cycle. With the present invention, although radical variances in button sizes may require interchangeable holders for controlling the button's planar displacement, the relationship of the button holder to the work remains constant. That is, with the present invention any interchangeable button turret assembly may be positioned with respect to the work with consistency regardless of button thickness. The relationship between the button turret assembly and the work support 16 is maintained constant by a unique mounting arrangement of the button turret assemblies 30 on the clamp. With the present invention, a constant distance is maintained between the clamp pivot point 41, provided by pin 43, and the underside or undersurface 42 of the button turret regardless of button thickness. In this manner, when the unalterable pivotal clamp assembly 18 is urged toward the work support 16, a constant relationship is maintained therebetween. The present embodiment is provided with a universal bolt 44 for securing the button turret to the clamp. The shank 45 of the bolt 44 serves as the rotational axis for the turret assembly. As described in the Hsiao patent, telescopically arranged on the shank 45 of bolt 44 are: a series of one way clutch means 46 and 48; spur gear means 50 comprising part of a universal assembly for indexing the button turret; and a button holder chuck means 52. The lower most end of the bolt is threadably engaged with a securing member 54 adapted to secure the button turret means 30 to the bracket means 24.

In the preferred embodiment, the thickest button turret, in the range of those available, is mounted to the clamp and an established distance "A" is set between the undersurface 42 of the button turret assembly and the unalterable pivot position 41 of the clamp assembly 18. Of course, any other constant premeasurable distance on the clamp may be used, but the described distance suffices for the purposes of this description. When a thinner button turret assembly is interchanged for the thickest button turret assembly, a shim or spacer means 56, of suitable thickness, may be interposed between the button turret and the bottom of the chuck means 52 such that the predetermined distance "A" remains unchanged. That is, this premeasured distance remains constant regardless of button thickness.

The establishment of an optimum distance between the button turret and the clamp yields a number of advantages. First, interchangeable button turret assemblies capable of controlling the planar displacement of the button may be employed without adversely affecting the clamping relationship of the turret and the workpiece. Second, when compared with its feasible alternatives, a reduction of parts may be appreciated with the present invention. That is, individual turret assemblies would normally require individual locking bolts. With the present invention, a single or universal locking bolt 44 may be used. Without the instant invention, individual turrets would require separate button holder chuck means. With the present invention, a single button holder chuck is employed. Without the present invention, a change in button thickness without a corresponding change in the spacing of the button holes would require a different orientating mechanism. With the present invention, buttons having like spacing between the button holes may use a universal button orientating mechanism.

As mentioned above, an integral part of the modular clamp assembly 18 is the loading mechanism 26. The loading mechanism 26 is disposed between the vibratory hopper 20 and the button turret assembly 30 of the machine. The loading mechanism of the present invention is similar to that shown in U.S. Pat. No. 4,069,777 granted Jan. 24, 1978 to Y. Ishikawa. In the patented apparatus, however, there was a lack of control over the planar orientation of the button being loaded. As a result, buttons could "ride up" on one another and jam against each other in their travel to the button turret. The provision of an improved loading mechanism has eliminated the "jam up" problem by controlling the buttons planar disposition. In this manner, the orientation of the button is controlled from the time it exits the button hopper until it is sewn to the workpiece.

Figure 4:
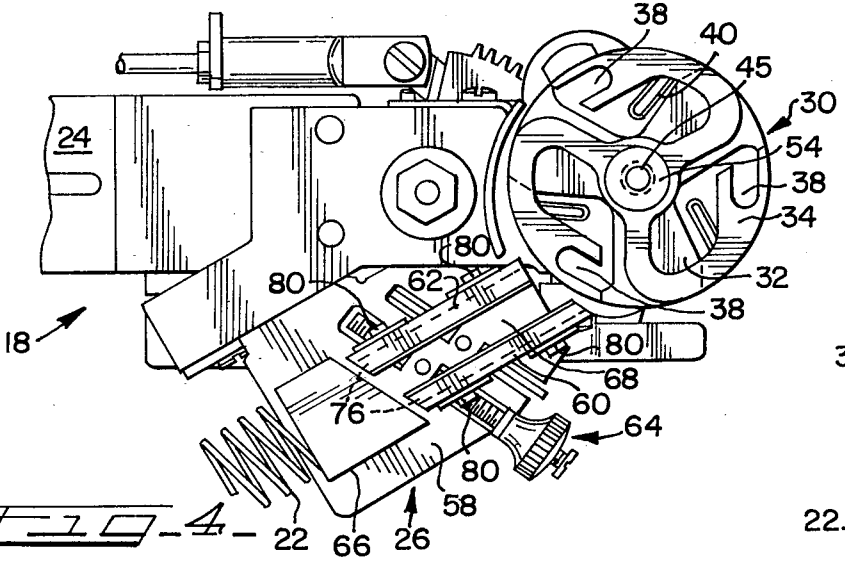
FIG. 4 is an enlarged partial bottom view of the present invention.
Figure 3:
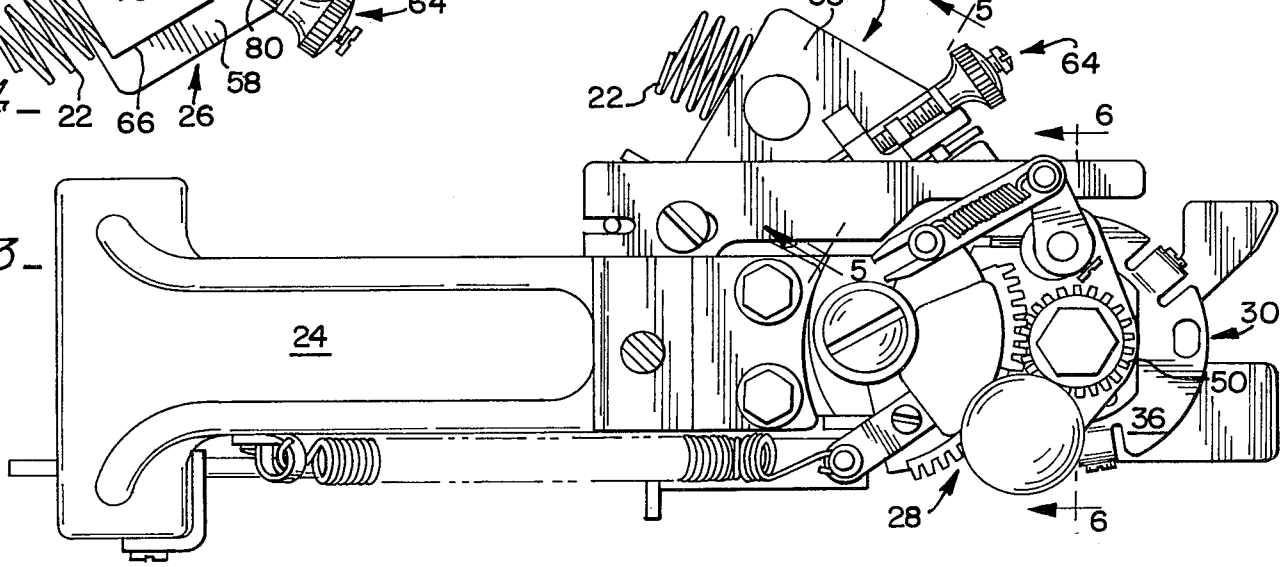
FIG. 3 is an enlarged top plan view of the present invention.

Broadly stated, the improved loading apparatus is comprised of a base member 58, a plurality of track forming members 60 and 62 and an adjustable support means 64. The base member is adjustably secured to the distal end of the bracket means 24 in a manner best described in the Ishikawa patent and incorporated herein by reference. As best seen in FIG. 4, the discharge end 66 of the resilient chute means 22 is detachably mounted to the base member 58. Mounted adjacent the discharge end of the resilient chute are the track forming members 60 and 62. The track forming members 60 and 62 are maintained in a horizontal disposition by the support means and form an elongated space generally indicated by reference number 68. The adjustment means 64 allows the space 68 between the tracks to be selectively moved toward or away from each other. Of course, the width of the space is substantially constant throughout the length of the tracks and is governed by the button diameter to be sewn.

As may be best seen in FIG. 5, each track is generally "C" shaped and includes an upper edge 70, a lower edge 72, and a side face 74 connecting the upper and lower edges. Interposed between the lower and upper edge is a median element 76. It is the space between the median element 76 and the lower edge 72 that controls the planar disposition of the button. The distance between the median element 76 and the lower edge 72 is variable independently of the adjustment between the track forming members 60 and 62. To accomplish this end, the side face 74 is provided with an elongated slot 78. In turn, the median element is provided with operator controlled locking means 80 that are arranged in the slot 78 and are adapted to secure the median element 76 in any preselectable position.

Control of the planar displacement of the button is made by manually inserting a button or other plate-like means into the guide tracks and adjusting the median element to a minimum clearance. As required, adjustments are made to the loading system so as to permit the button to travel through the guide tracks with a minimum of retardation while maintaining control of its planar orientation. The advantages of such a mounting system are apparent when considering the design of the loading assembly. With the present invention, the "ride up" of one button upon another is avoided. By allowing the guide tracks to adapt to both the button width and thickness, a singular or universal loading assembly can be attached to the clamp, whereby eliminating different parts. With the button turret being disposed in a constant relationship relative the clamp, regardless of button thickness, the lower guide surface 72 on the tracks 60 and 62 also remains constant. Thereby, timely vertical adjustment of the guide tracks is avoided.

By comparing the present invention versus the machine shown in the Hsiao patent, the advantages of the present invention are apparent. First, the present invention provides control of the button's planar displacement regardless of button size or thickness. Second, control over the button's planar orientation is maintained from the button supply source to the point whereat it is secured to the workpiece. Third, the clamping relationship of the button turret with the work support is maintained relatively constant whereby minimizing machine malfunction. Finally, the above advantages are achieved by employing modular mechanisms whereby minimizing part inventory.

Thus, it is apparent that there has been provided, in accordance with the invention, a button clamp assembly that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described the invention, what we claim is:

1. Interchangeable button clamp assemblies for a sewing machine, each button clamp assembly comprising:

interchangeable button turret means capable of transferring buttons between a loading station and a sewing station and having a holder adapted for a particular range of button ligne and thickness, said holder being movable into and out of engagement with a workpiece being sewn;

universal means for orientating a button arranged in said holder before sewing;

universal means for indexing the holder through a series of predetermined steps; and a universal button clamp for interchangeably carrying any of said button turret means in a manner permitting the holder to engage the workpiece with consistency regardless of button size.

2. A method for conveying buttons of varying thicknesses to the sewing station of a machine comprising the steps of:

conveying and controlling the planar displacement of one thickness of button from a loading station to a sewing station with one size conveyance means carried on a lever;

conveying and controlling the planar displacement of a different thickness of button from a loading station to a sewing station with a different sized conveyance means carried on a said lever means; and maintaining the displacement of said lever generally constant relative to said workpiece regardless of which conveyance means is employed for transmitting the button from the loading station to the sewing station.

3. In combination with a button sewing machine for securing various sized buttons to workpieces, said sewing machine includes a reciprocatory needle and a button clamp assembly comprising;

a pivotally mounted clamp adapted for movement between a raised position and a generally horizontal lowered position; and interchangeable button receiving subassemblies for transporting buttons from a loading station to beneath said needle, each of said subassemblies being dimensioned according to the particular sized button being sewn, each of said button subassemblies being interchangeably mounted on said clamp to permit the lowered horizontal position of said clamp to remain generally constant relative to the workpiece being sewn regardless of button thickness.

4. In combination with a sewing machine having a work support and a reciprocatory needle for securing various sized plate-like articles to a workpiece, an apparatus for delivering such various sized plate-like articles to and removing them from the path of the needle plane defined by the reciprocatory path of the needle, said apparatus comprising:

turret means adapted to receive such articles in succession and carry same to the path of the needle plane, said turret means being dimensioned as a function of the article's size so as to maintain said articles in a planar orientation extending parallel with the work support;

driver means for indexing said turret through a series of predetermined steps;

means for mounting said turret means on said machine for pivotal movement between a first position whereat the turret means engages the workpiece and a second position, said mounting means permitting the orientation of said turret means to remain generally constant relative to said work support regardless of the turret means dimensions.

5. In combination with a sewing machine having a work support and a reciprocatory needle for securing various sized plate-like articles to a workpiece, an apparatus for delivering such various sized articles to and removing them from the needle's path, said apparatus comprising:

turrent means dimensioned according to the articles' thickness and diameter and adapted to receive, carry and maintain such articles in a planar orientation extending parallel with the work support during the needle's reciprocation;

driver means for indexing said turret means through a series of predetermined steps; and means for mounting said turret means for pivotal movement between a first position whereat said turret means engages a workpiece on said work support means and a second position whereat said turret means is removed from contact with said workpiece, said mounting means permitting the turrent means to maintain a generally constant orientation relative to said workpiece regardless of the turret dimensions.

6. Interchangeable button clamp assemblies for a button sewing machine having a material work support, said clamp assemblies comprising;

a series of interchangeable turret assemblies capable of transporting a range of button sizes to a sewing station of the machine, each of said assemblies including an apertured button receptacle means the dimensions of which are directly related to the diameter and thickness of the buttons being sewn;

means for mounting any size turret assembly in a manner whereby the receptacle means can be moved toward or away from the work support and engage the material supported on said support with consistency regardless of button size.

7. For use with a sewing machine having a work support and reciprocatory needle means, an apparatus comprising:

a hopper having a discharge aperture;

a chute having an inlet end positioned adjacent the hopper's discharge aperture and an outlet end;

a button turret assembly arranged at the other end of said chute for sequentially receiving and transporting buttons between a loading station and a sewing station, said turret assembly includes a member having a series of button receiving recesses of a configuration conforming to the thickness and diameter of the button being sewn;

driver means for indexing the turret assembly through a series of predetermined steps; and means for mounting said turret assembly for pivotal movement between a lowered position whereat said member engages a workpiece arranged on said work support and a raised position, said mounting means permitting the member to maintain a constant orientation relative to the workpiece when the turret assembly is in its lowered position regardless of the members configuration.

8. The invention of claim 7 further including an adjustable support means interposed between said turret assembly and the outlet end of said chute for maintaining the buttons in a planar orientation.

9. The invention of claim 8 wherein said support means includes first and second guide track means defining a button guide track that is selectively adjustable as a function of button thickness and diameter.

10. The invention of claim 9 wherein the button guide track is maintained parallel with said member regardless of the position of said button turret assembly.

* * * * *